US006273011B1

(12) United States Patent
Amos

(10) Patent No.: US 6,273,011 B1
(45) Date of Patent: Aug. 14, 2001

(54) HOLLOW NEEDLE TUFTING APPARATUS AND METHOD

(76) Inventor: Kim K. Amos, 460 Pebblestone Dr., Ringold, GA (US) 30736

( * ) Notice: Subject to any disclaimer, the term of this patent is extended or adjusted under 35 U.S.C. 154(b) by 0 days.

(21) Appl. No.: 09/593,249

(22) Filed: Jun. 13, 2000

Related U.S. Application Data

(60) Provisional application No. 60/164,479, filed on Nov. 10, 1999.

(51) Int. Cl.[7] ..... D05C 15/16
(52) U.S. Cl. ..... 112/80.7; 112/222
(58) Field of Search ..... 112/80.7, 80.05, 112/80.08, 80.16, 80.4, 98, 100, 222, 224

(56) References Cited

U.S. PATENT DOCUMENTS 202,237 * 4/1878 Cross ..... 112/222
3,356,048 * 12/1967 Haas ..... 112/80.7
3,595,185 * 7/1971 Shorrock ..... 112/80.08
4,931,129 * 6/1990 Bartlett et al. ..... 112/80.7 X
5,165,352 * 11/1992 Ingram ..... 112/80.7 X

* cited by examiner

*Primary Examiner*—Ismael Izaguirre
(74) *Attorney, Agent, or Firm*—Alan Ruderman; Miller & Martin LLP

(57) ABSTRACT

A method and apparatus for tufting comprises a hollow tufting needle supplied with a plurality of yarns. The plurality of yarns are maintained within the cavity of the needle. One of the yarns is selectively fed out of a yarn opening by releasing the yarn from a yarn feed device and utilizing an air injector proximate to the yarn entrance of the needle to assist in expelling the selected yarn from the needle. When a different yarn is desired to be utilized, the yarn feed device secures the previously selected yarn and another yarn is selectively fed in a similar manner as the first yarn. The needle utilized includes a plurality of holes or vents angled relative to the axis of the needle.

20 Claims, 3 Drawing Sheets

HOLLOW NEEDLE TUFTING APPARATUS AND METHOD

This application claims benefit to U.S. provisional application No. 60/164,479 filed Nov. 10, 1999.

BACKGROUND OF THE INVENTION

This invention relates to tufting machines for producing tufted textile goods such as carpet, upholstery and the like and more particularly to a hollow needle tufting machine of the type disclosed in U.S. Pat. Nos. 4,549,946; 4,991,523; 5,080,028; 5,158,027; 5,165,352; 5,205,233 and 5,267,520 and is an improvement over the apparatus and methods disclosed therein.

U.S. Pat. No. 4,549,946 discloses a tufting apparatus of this type for producing patterned tufted goods using yarns of different colors or different textures. This apparatus is capable of placing yarn into a backing to create patterns and designs which were then previously generally available only from a weaving loom or by using printing techniques. The apparatus employed multiple heads spaced across the width of a backing material. Each head included a reciprocating hollow needle for penetrating the backing and for implanting yarn tufts into the backing by feeding yarn through the needle pneumatically. The needle is connected to a yarn exchanger into which a plurality of yarns of different colors, for example, are supplied and a mechanism is included which enables a selection of a yarn for implantation into the backing for each penetration by the needle. The multiple heads were stepped in synchronism across the backing for a distance corresponding to the spacing between the heads in order to implant a transverse row of yarn tufts. The backing was then advanced to the position of the next row and the process repeated to implant the next row. A computer controlled the selection of the yarn implanted by each needle for each penetration of the backing in order to produce a desired pattern in the finished goods.

A significant factor influencing the production speed of practical apparatus employing the aforesaid patented disclosure is the number of tufting heads embodied in the apparatus. The greater the number of heads, the less distance each head had to traverse and, accordingly, the faster a row of tufts could be implanted into the backing. As the number of heads increased, however, other problems arose. The increased weight made it more difficult to move the heads accurately and to maintain their alignment and positions relative to one another. Thus, rather than the multiple heads which carry the hollow needles being moved across the backing, U.S. Pat. No. 4,991,523 proposed that the backing rather than the heads be shifted transversely to move substantially less weight. Not only did this simplify the transverse shifting apparatus but also provided greater speed and accuracy to the yarn placement.

The shifting of the backing material results in a number of transversely spaced stitches produced by each needle, the spacing between adjacent stitches or tufts being equal to the stitch gauge of the product produced. For example, if the needles are spaced apart by two inches, as has been and remains the case in the machines produced using the disclosures of the aforesaid patents, and the gauge or space between adjacent stitches is 1/10 inch, the backing is shifted a total of 20 steps from the first penetration of the backing by a particular needle to the last penetration of the backing by that needle before the fabric is shifted in the opposite direction. Accordingly, if the needles could be spaced apart by less than the two inches mandated in the prior art in view of the number of feed mechanisms involved, i.e., a separate feed mechanism for each yarn for each needle, then the number of shifts required to be made by the fabric would be less and therefore the time required to produce a fabric of a given length would be reduced. This, of course, translates into an increased speed of operation, speed being a major drawback of machines in the prior art.

Another significant factor influencing the cost and accuracy of this type of tufting apparatus is the control over the feeding of the yarn to the hollow needles. The feeding of the yarn must be positive, and when a yarn change is to be made for a particular needle, the yarn previously stitched by the needle has to be positively withdrawn from the needle so that the subsequent yarn will not be blocked by the previously sewn yarn. Unless this withdrawal of the previously sewn yarn in the prior art apparatus and method is assured, a substantially greater air pressure is required to supply the subsequent yarn through the needle. Furthermore, when the yarn is withdrawn from the needle, unless the yarn withdrawal is controlled, the next time that yarn is required to be fed to the needle an accurate and consistent length of yarn can not be assured. This would also result in requiring additional air pressure to assure that a sufficient length of yarn is supplied. The effect is that a greater than required amount of pressure must be utilized, and if too much yarn is supplied to the needle additional yarn shearing operations are required for producing a satisfactory product. Accordingly, in U.S. Pat. No. 5,080,028 a pullback mechanism is disclosed which is disposed between the yarn feeder and the hollow needle, the pullback mechanism acting to pull the yarn a preselected amount from the needle so that the yarn passageway in the needle is not restricted by the previous yarn when a subsequent yarn is to be sewn. Additionally, to assure that the pullback mechanism draws the yarn from the needle and not from the yarn supply or the feed roller, clamping apparatus had to be disposed between the yarn feed roller and the pullback mechanism to positively clamp the yarn when the yarn change is to be made. The pullback mechanism is thereafter activated and the yarn feed roller ceases positive feeding of the yarn. Thus, the yarn pullback mechanism draws a predetermined amount of yarn from the needle maintaining it in reserve until again required. Additionally, the yarn feed roller as it ceases positive feeding draws a preselected amount of yarn from the yarn supply for subsequent use when needed. When the needle is to commence stitching with a particular yarn, the yarn feed roller is activated and the yarn clamping apparatus and yarn pullback mechanism are deactivated.

A further significant factor affecting the efficiency and cost of the aforesaid apparatus and its operation is the amount of pressurized air that must be supplied to feed a selected yarn through the system from the yarn injectors which receive the yarn associated with a respective needle and directly on through separate passageways to the yarn exchanger in which yarn exchange occurs. In the early machines, air was supplied to a plenum from which air was directed to a tapered space leading into each yarn carrying conduit extending to the yarn exchanger. Air was thus constantly supplied to the plenum under high pressure to drive the yarn fed by the yarn feed rollers. This resulted in a substantial amount of wasted air and the system was thereafter modified. Air flow was then regulated and controlled so that air under a high pressure was only supplied to a passageway having the selected yarn for injection into and through the needle, while air under a low pressure is supplied to the other passageways. Thus, both low and high pressure air flows into the funnel of the yarn exchanger.

This, however, resulted in a turbulence so that the various yarns became entangled, and this problem was in turn solved by disposing an air jet in the yarn exchanger adjacent to the entry to the needle for blowing air into the needle inlet to prevent the selected yarn from being diverted and tangled with one or more of the other yarns.

The yarn exchanger in these machines has the form of a funnel with each yarn adapted to enter the enlarged end through a separate passageway and the air jet is in the form of a nozzle disposed for blowing the selected yarn into the needle. The selected yarn is fed to the needle by high pressure air within its passageway while low pressure air flows through the other passageways. Accordingly, a substantial amount of air under pressure to must be directed into the yarn exchanger funnel.

With all these changes the method and apparatus heretofore discussed still retains major drawbacks that substantially and significantly limit its acceptance. First and foremost is the slow production rates because of the spacing between adjacent needles, and the other major drawback is the high energy consumption and noise levels due to the large amount of compressed air that must be utilized for the aforesaid reasons. The high air consumption has also been a limiting factor toward increasing production rates by precluding an increased number of hollow needles per machine.

Thus, it may be seen that there has always been a need for greater speed and thus production efficiency for these hollow needle tufting machines and that there is a need to reduce the amount of air required by the machines to reduce production cost. Additionally, not only does the large air flows require large compressors, but the noise levels associated with these air flows is great.

SUMMARY OF THE INVENTION

Consequently, it is a primary object of the present invention to provide a hollow needle tufting machine and a method for operating the same with increased production rates and lower air flow requirements than machines of the prior art.

It is another object of the present invention to provide apparatus permitting a greater number of needles in a hollow needle tufting machine than permitted by the prior art.

It is a further object of the present invention to provide a method and apparatus permitting a plurality of yarns to be disposed within a hollow needle of a hollow needle tufting machine and not pulling any of the yarns which are not being sewn back out of the needle.

In accordance with the present invention the requirement for a yarn exchanger has been eliminated and all of the yarns to be sewn by a given needle are maintained within the needle below the entry thereto and just above the exit opening. The plurality of yarns that are not being sewn are not retracted from the needle thereby removing the necessity of having a yarn exchanger as in the prior art, and the plurality of yarns are held within the needle during the machine cycle by a single air injector, preferably with multiple jets or openings, disposed at the entry to the needle.

Furthermore, it may be possible to remove the high and low air solenoids, air solenoids formerly required for retracting arms, air cylinders for retracting arms, some air manifold assemblies, individual yarn injectors, individual tubes or conduits for each yarn, some assemblies formerly required of a needle bar, an individual supply of air for each yarn at any given time, flexible ribbon hoses provided from air manifold assemblies to each individual yarn, and/or final entries over a needle inlet at the needle bar. Of course, in some embodiments many of these elements may be retained, as so desired.

Additionally, an improved needle includes a plurality of openings located along its length. Preferably these openings are drilled at angles relative to the length of the needle to unsubstantially affect the airflow in the downward direction. However the holes may act as relief vents when air moves in the upward direction, such as may result from back pressure generated when the bottom of the needle (typically the pointed end with the yarn opening) is obstructed during the tufting and/or cutting process.

The angled holes along the length of the needle have been found to reduce the tendency of back pressure generated during the tufting process to force yarns out of the top of the needle, thereby "unthreading" the needle and inhibiting the sewing process.

These changes reduce the amount of air required during operation and not only reduce the size and cost of the required compressor, but also the noise levels associated therewith to acceptable levels. By eliminating the multiplicity of yarn exchangers, which in the prior art comprises one yarn exchanger per needle, a substantially greater amount of space is made available for mounting additional yarn feed mechanisms. Thus, the number of needles may be increased accordingly so as to increase the production speed of the machine.

Consequently, the present invention eliminates the yarn exchangers of the prior art and disposes all of the yarns within each needle. Eliminating the yarn exchangers provides space for additional yarn feed mechanisms. Since there is one yarn feed mechanism for each yarn per needle, additional needles may be carried by the needle bar. Increasing the number of needles, increases the productivity and effectively the speed of the machine. Furthermore, a significant decrease in the number of rotating parts, i.e., mass, allows for higher needle bar reciprocating speeds due to reduced forces and vibration levels. Higher reciprocation speeds may result in higher production levels due to higher obtainable machine speeds. Thus, not only does the present invention provide lower production costs and machine costs by reducing the amount of air flow required, but productivity may be increased substantially.

It is anticipated that at least twice as many needles may be utilized in a hollow needle tufting machine of this type so that the space between adjacent needles rather than being two inches as required in the prior art may be no more than, and possibly less than, one inch between needles. With a gauge of 1/10 inch, as opposed to the 20 steps required in the prior art, only 10 steps are required by a machine having twice the needle constructed in accordance with the present invention. Accordingly, the effective speed of the machine is at least double that of the prior art. It may also be that the space made available for feed mechanisms by means of the present invention will prove to be such that more than twice the number of feed mechanisms may be used. In that case the expected speed of the machine would be increased accordingly.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
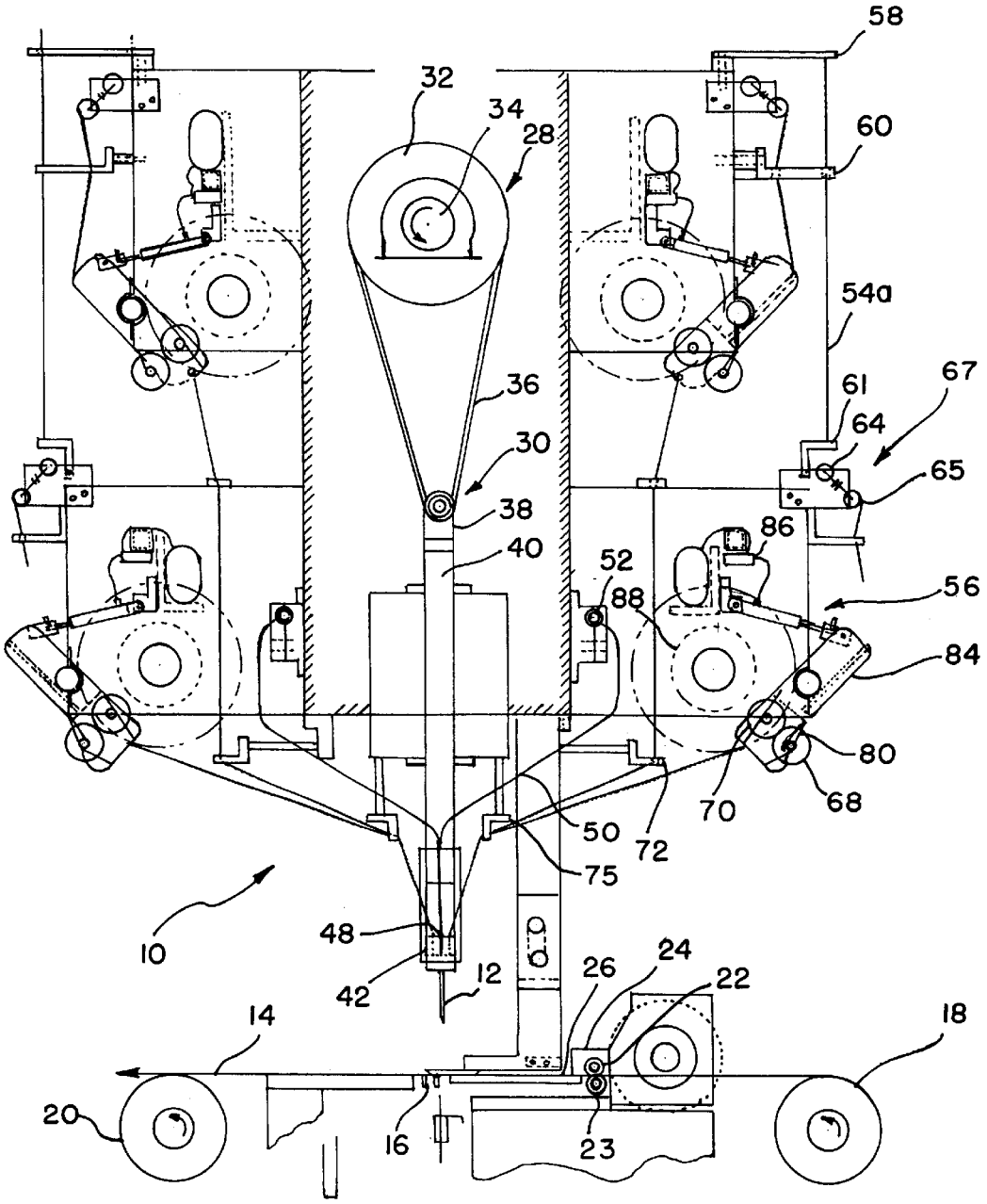
FIG. 1 is a side elevational view, in cross section and diagrammatic, of tufting apparatus embodying the present invention.

FIG. 1 illustrates a tufting machine 10 constructed in accordance with the principles of the present invention, the machine having a plurality of hollow and perforated needles 12 (illustrated in greater detail in FIGS. 3 and 4) for penetrating a backing material 14 to implant yarn tufts 16 therein. The backing material 14 may be advanced longitudinally past the reciprocating needles by a backing advance or feeding system which may comprise a pair of pin rollers 18 and 20 which are driven my motors (not illustrated) at slightly different rotational speeds so as to maintain the backing under tension as it passes beneath the reciprocating needles. The backing advance system may include guide rollers (not illustrated) which cooperate with the pin rollers to guide the backing. A second pair of pin rollers 22, 23 carried by a frame 24 may be mounted above and below the backing material so as to aid in shifting the backing material laterally or transversely. The backing movement through the machine is not continuous, but is moved in steps at a rate substantially equal to half of the stitch rate per step. During each step the backing is also shifted one lateral or transverse step.

Thus, each needle may insert yarn into the backing at a number of transverse locations. The transverse positioning mechanism (not illustrated) may be any of a number of commercially available devices and, in accordance with advantages provided by the present invention may be a servo motor, gear motor or a linear actuator which may drive the needle plate 26 over which the backing is fed and which acts with the rollers 22, 23 and frame 24 to shift the backing in accordance with a pattern.

The needles 12 may be reciprocated by an adjustable cam assembly 28 which is coupled to the needles by a link assembly 30, the adjustable cam assembly comprising a cam 32 essentrically mounted on a main shaft 34 and connected by a yoke member or connecting strap 36 to the link assembly. The link assembly 30 may comprise a connecting link 38 which is pivotally connected to the push rods 40 at the lower ends thereof so as to reciprocate the push rods. The needle bar 42 is connected at the lower ends of the push rods and carries the needles 12. The yarn exchanger as used in the prior art may be eliminated and the needle bar 42 need not have a funnel entry or individual conduits for yarns in order to eliminate mass. However, some or all of these elements may be useful in some embodiments.

Disposed within the needle bar is a tube 48 which comprises an air injector for blowing air to maintain the positions of the plurality of yarns within the needle bar 42 for reasons hereinafter described. Preferably, as illustrated, the lower ends of the injector is at the exit of the needle bar 42 and in the inlet of the needles 12. The injector preferably includes a plurality of jets or openings 49. The injector may have a larger diameter than the interior passageway of the needle 12 in order to ensure adequate airflow into the needle 12. As hereinafter described, each injector is fed with air from an air supply line 50 fed with air from an air manifold 52. Locating the air injector 48 in the position illustrated at the inlet of the needle rather than in a funnel in a raised position above the needle as in the prior art, air within the funnel may be "eliminated" so as to eliminate the turbulent flow characteristics in the finnel of the prior art apparatus. It also ensures that the yarn strands are maintained within the needle.

A plurality of yarn strands 54*a*, 54*b*, 54*c*, 54*d*, 54*e*, 54*f* fed by means hereinafter described are disposed within the body of the needle at all times. Because of this, the yarn exchangers required in the prior art apparatus are no longer required. Thus, space is made available for mounting a substantially greater number of yarn feed devices 56 than has been available in the prior art. A yarn strand e.g. 54*a* from a source, such as a creel (not illustrated) is fed to the machine and enters through a top yarn guide 58, is fed through other yarn guides 60, 61 and through a tension device 62 comprising a pair of rolls 64, 65 to another yarn guide 66. From this yarn guide the yarn strand is threaded through the yarn feed mechanism 56 between a pair of gears 68, 70 to a lower yarn guide 75. Another yarn guide 72 may be included for feed mechanisms disposed at upper portions of the machine. The lower yarn guide 75 receives a plurality of different yarns e.g. 54*a*, 54*b*, 54*c*, 54*d*, 54*e*, 54*f*.

In the prior art, air was continuously supplied to the passageways, low pressure being supplied to those yarns which were not selected to be sewn into the backing while high pressure air was supplied to the yarn passageway selected to be sewn into the backing on a particular stitch. Thus, air was always applied to the tubes. In accordance with the present invention this is not necessary, nor are the parts necessary. However, in some embodiments, some or all of these elements may be used with the structure and methodology taught herein. During the needle thread-up process, the yarn is forced by the air injector into the needle 12. During the tufting process the yarn being sewn and the other yarns within the needle are held in the needle by air pressure acting on the yarns from the injector 48.

Each yarn for each needle has a separate yarn feed apparatus 56, a computer or the like (not illustrated) programmed with a pattern conventionally selects the particular yarn which is to be tufted into the backing material. The yarn is selected by activating the yarn feed mechanism 56 for that particular yarn. As aforesaid, this mechanism comprises a pair of gears 68, 70 that are spring loaded so as to be forced together by means of a leaf spring 80. The gear 70 has a fixed shaft, while the other gear 68 has a floating shaft. Because yarn is threaded between the gears, the gears hold the yarn and prevent the yarn from feeding to the needle unless a particular yarn is selected. An air actuator 82 extends to a pivotally mounted arm 84 on which the gear 68 is mounted, the other end of the air actuator being connected to a solenoid valve 86 which when opened permits air to flow to the actuator. Moreover, the gear 70 meshes with a feed gear 88 that is rotated by a servo motor, or gear motor, actuated when the solenoid 86 is actuated thereby to rotate the gears to feed the selected yarn strand e.g. 54*a*. The air from the injector 48 within the needle bar thereafter blows or drives the yarn through the needle. By timing the reciprocation of the needle bar with the feeding of the yarn, a stitch is sewn into the backing material after the needle penetrates the backing. As the needle exits the backing, the yarn remains therein in view of the flow of the air through the needle and the backing closes around the yarn. As the needle reciprocates above the backing material, the backing feeds longitudinally and traverses laterally by means of the lateral shifting apparatus and the needle is thereafter again reciprocated in a downward path, the same or another yarn being selected to be fed through the needle into the backing. The apparatus may include a cutting mechanism including a blade 90 for cutting the yarn which has been tufted into the backing. After a tuft has been formed, the gear mechanism of the feed mechanism for that particular yarn may be deactivated so that although that yarn will remain within the needle, it will not again sew or tuft until it is again selected by the computer. Another yarn residing within the needle may be selected to thereafter be fed and sewn as described.

Figure 4:
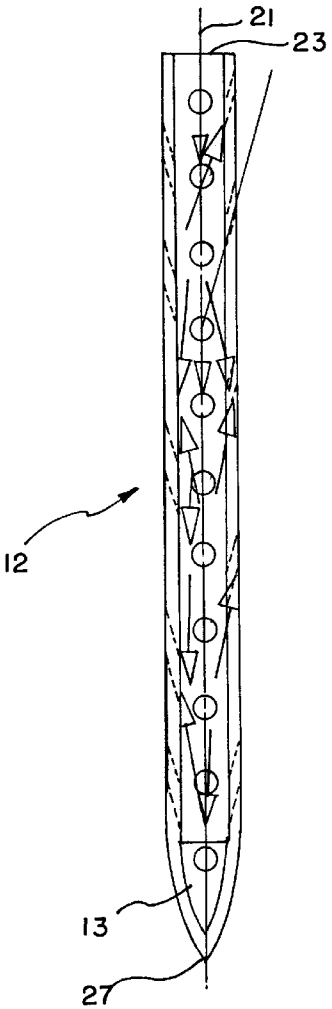
FIG. 4 is a fragmentary elevational view of a single needle illustrated in FIG. 3.
Figure 3:
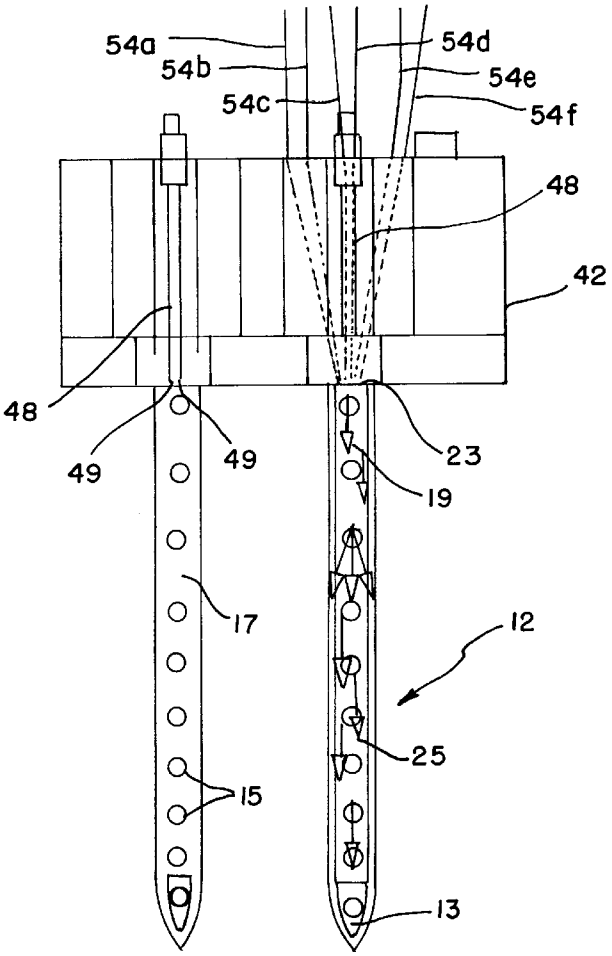
FIG. 3 is a fragmentary rear elevational view greatly enlarged illustrating a pair of needles and the needle bar and injector portion of the apparatus illustrated in FIG. 1.

The needles 12 of the preferred embodiment are illustrated in greater detail in FIGS. 3 and 4. The needles 12 may include a plurality of vents or holes 15. The holes communicate an exterior surface 17 with an interior surface 19 of the needle 12. Furthermore the holes 12 may be drilled, or otherwise formed, in the needle 12 during the process of making the needles 12 at at least one angle $\alpha$ relative to an axis 21 located along the length of the needle 12 and directed in the upward direction toward the needle bar 42. It is preferred that a single angle $\alpha$ be between about 5 and about 80 degrees, between about 10 and about 70 degrees, between about 15 and about 60 degrees, and between about 20 and about 45 degrees. Multiple angles $\alpha$ could also be utilized.

As illustrated in FIG. 3, yarns 54*a–f* enter the needle 12 at inlet 23 and proceed into the needle cavity 25 where they remain until one of the yarns is selected for use as described above. Once selected for use, the yarn exits the cavity 25 at yarn exit 13 and may be sewn, or tufted, into a backing material when the point 27 penetrates the body material.

Figure 2:
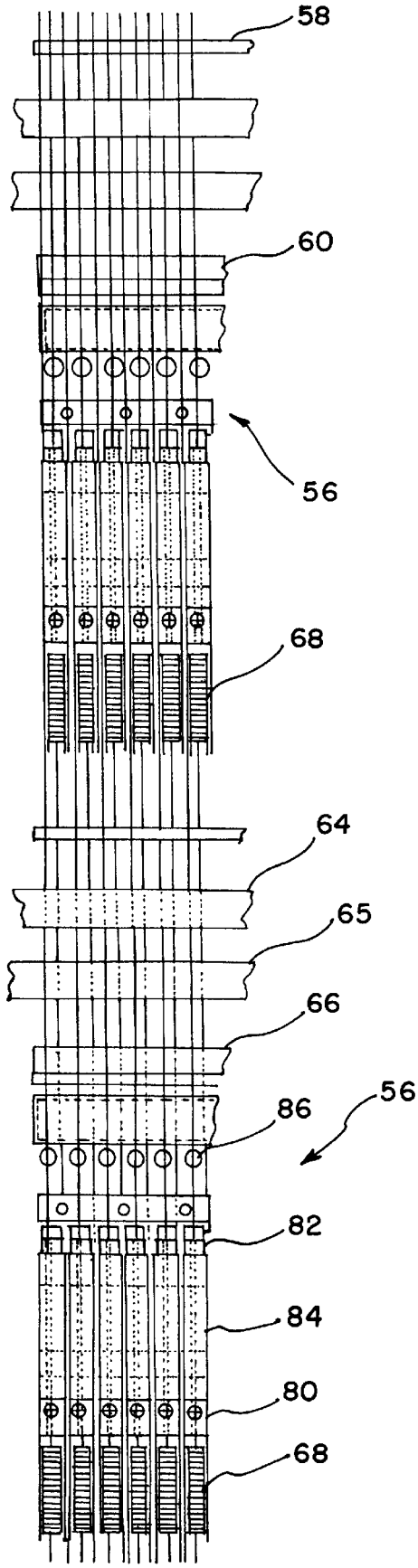
FIG. 2. is a fragmentary front elevational view of the yarn feed apparatus associated with two needles of the present invention.

Since all the yarns that are to be selected to be sewn by a needle remain within the needle, the yarn exchangers are not required. This provides space for additional yarn feed mechanisms so that banks of such mechanisms may be aligned transversely at both upper and lower locations as illustrated in FIG. 2. Thus, at least twice the number of feed mechanisms may be used. This thereby allows at least twice the number of needles and hence at least twice the effective speed of the machine relative to the prior art. A reduction in mass of reciprocating parts also affords higher speeds and additional production.

Another advantage of the construction includes the ability to reduce the amount of compressed air supplied for any given needle. Instead of having an injector for each yarn supplied to a needle, the preferred embodiment utilizes a single injector 48 for all the yarns supplied to a given needle. Therefore, the quantity of compressed air supplied to a particular tufting machine is drastically reduced making closer needles more practical, if so desired.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of tufting using a hollow needle having a cavity therein starting at a yarn inlet and ending at a yarn exit comprising:

supplying a plurality of yarns into the cavity of the needle;

maintaining the plurality of yarns within the cavity of the needle; and feeding one of the plurality of yarns selectively out of the yarn exit.

2. The method of claim 1 wherein the step of feeding one of the plurality of yarns further comprises supplying air through an injector into the cavity of the needle to direct the one of the plurality of yarns out of the yarn exit.

3. The method of claim 1 further comprising the step of penetrating a backing material with the one of the plurality of yarns fed from the yarn exit.

4. The method of claim 1 wherein the step of supplying a plurality of yarns into the cavity of the needle includes directing the plurality of yarns through the yarn inlet of the needle.

5. The method of claim 1 wherein the step of selectively feeding the one of the plurality of yarns out of the yarn exit further comprises activating a yarn feed mechanism to at least assist in delivering yarn to the needle.

6. The method of claim 5 wherein the step of activating the yarn feed mechanism further assists in delivering the one yarn out of the yarn exit.

7. The method of claim 1 wherein the step of maintaining the plurality of yarns within the cavity of the needle further comprises supplying air through an injector into the cavity of the needle.

8. The method of claim 1 further comprising the step of supplying a needle having a plurality of vents angled relative to an axis along a length of the needle.

9. The method of claim 8 wherein the angle of the vents relative to the axis is between about 5 and about 60 degrees.

10. The method of claim 9 wherein the angle of the vents relative to the axis is about 20 degrees.

11. An apparatus for tufting comprising:

a reciprocating hollow needle having a cavity therein starting at a yarn inlet and ending at a yarn exit, and said needle having a plurality of vents angled relative to an axis along a length of the needle;

an air injector disposed proximate to the yarn inlet of the needle;

a conduit supplying air to the air injector; and a plurality of yarns located within the cavity of the needle.

12. The apparatus of claim 11 wherein the air injector comprises a plurality of jets.

13. The apparatus of claim 11 wherein the reciprocating needle is connected to a cam assembly.

14. The apparatus of claim 11 wherein the needle further comprises a point located below the yarn exit.

15. The apparatus of claim 11 wherein the plurality of vents are disposed at a single angle relative to the axis along the length of the needle.

16. A hollow needle comprising:

a yarn inlet, a cavity, and a yarn exit; and a plurality of vents located along an exterior surface of said needle communicating with an interior surface of the needle in the cavity of the needle, said plurality of vents disposed at least one angle relative to an axis along a length of the needle.

17. The needle of claim 16 wherein said plurality of vents are disposed at a single angle relative to the axis along the length of the needle.

18. The needle of claim 17 wherein the angle of the plurality of vents is between about 5 and about 60 degrees relative to the axis.

19. The needle of claim 18 wherein the angle of the plurality of vents is about 20 degrees relative to the axis.

20. The needle of claim 16 further comprising a point located below the yarn opening.

* * * * *